US005920004A

United States Patent [19]

Gottshall et al.

[11] Patent Number: 5,920,004

[45] Date of Patent: Jul. 6, 1999

[54] METHOD OF CALIBRATING AN INJECTOR DRIVER SYSTEM

[75] Inventors: Paul C. Gottshall; Ricky L. Crebo, both of Washington, Ill.

[73] Assignee: Caterpillar Inc., Peoria, Ill.

[21] Appl. No.: 08/855,326

[22] Filed: May 13, 1997

[51] Int. Cl.[6] ..... F02M 65/00

[52] U.S. Cl. ..... 73/1.36; 123/480; 123/486; 123/490

[58] Field of Search ..... 73/1.36, 119 A; 123/480, 486, 490

[56] References Cited

U.S. PATENT DOCUMENTS

| | | | |
|---|---|---|---|
| 4,255,789 | 3/1981 | Hartford et al. | 123/406.65 X |
| 4,631,628 | 12/1986 | Kissel | 123/490 X |
| 5,111,787 | 5/1992 | Kondo | 123/585 |
| 5,113,827 | 5/1992 | Vincent | 123/339.11 |
| 5,178,115 | 1/1993 | Daly | 123/470 |
| 5,483,941 | 1/1996 | Cullen et al. | 123/481 |
| 5,611,751 | 3/1997 | Ehrenhardt et al. | 477/73 |

FOREIGN PATENT DOCUMENTS 200849 7/1994 Japan .

*Primary Examiner*—Thomas P. Noland
*Attorney, Agent, or Firm*—Mary Jo Bertani; R. Carl Wilbur

[57] ABSTRACT

A method of calibrating an injector driver system including an injector driver circuit, a logic device connected to an input line of the injector driver circuit, and an information storage device associated with the logic device, involves testing the injector driver circuit once assembled. A predetermined test is connected to the injector driver circuit. A pulse width modulated signal having a predetermined duty cycle is applied to the input line of the injector driver circuit and the corresponding current level through the test load is measured. A value indicative of the measured current level is stored in the information storage device for later retrieval during operation of the injector driver system.

13 Claims, 2 Drawing Sheets

METHOD OF CALIBRATING AN INJECTOR DRIVER SYSTEM

TECHNICAL FIELD

This invention relates generally to the field of solenoid driver circuits and more particularly, to a method for calibrating an injector driver system during production so as to achieve improved system accuracy.

BACKGROUND ART

Currently, injector driver systems are commonly used for fuel injection control in engine applications. The injector driver system typically includes logic means operable to apply a number of pulse width modulated (pwm) input voltage signals having predetermined analog command to an injector driver circuit. Based upon each of the command signals, the injector driver circuit delivers a current to the corresponding fuel injectors of the engine, which current is proportional to the duty cycle of the pwm signal. Due to variations in components used to build injector driver systems, some difference or error between the current actually delivered for a given command signal and the current expected to be delivered for the given command signal generally exists.

Previously, the necessary command signal was determined based upon expected driver performance assuming nominal or ideal component values and performance. The expected driver current was compared to the actual current delivered during operation. If inaccuracies were found the injector driver system would be either reworked with additional components or higher precision and accordingly higher cost components, or the system would be scrapped. Both of these alternatives greatly increase manufacturing costs for such injector driver systems.

Accordingly, the present invention is directed to overcoming one or more of the problems as set forth above.

DISCLOSURE OF THE INVENTION

In one aspect of the present invention a method for calibrating an injector driver system on the production line is provided. The injector driver system includes an injector driver circuit, logic means connected to an input line of the injector driver circuit, and information storage means associated with the logic means. The method involves connecting a predetermined test load and a test electrical energy source to the injector driver circuit. A predetermined signal is applied to the input of the linear driver circuit and a corresponding current level through the test load in response thereto is measured. A value indicative of the measured current level is stored in the information storage means for later retrieval during operation of the injector driver system. The stored value may be a determined compensation factor which is a ratio of a predetermined nominal current value and the measured current level of the uncalibrated injector driver system.

This calibration method allows less accurate, lower cost individual components to be used in the injector driver system, without sacrificing overall system accuracy because of the testing and calibration described herein. The stored value is then used by the logic means to determine the appropriate duty cycles of the pwm signals which are applied to the injector driver circuit in a real application. In the present method, either a single current level is measured, or a number of current levels may be measured and then averaged.

BRIEF DESCRIPTION OF DRAWINGS

For a better understanding of the present invention, reference may be made to the accompanying drawings in which.

BEST MODE FOR CARRYING OUT THE INVENTION

Figure 1:
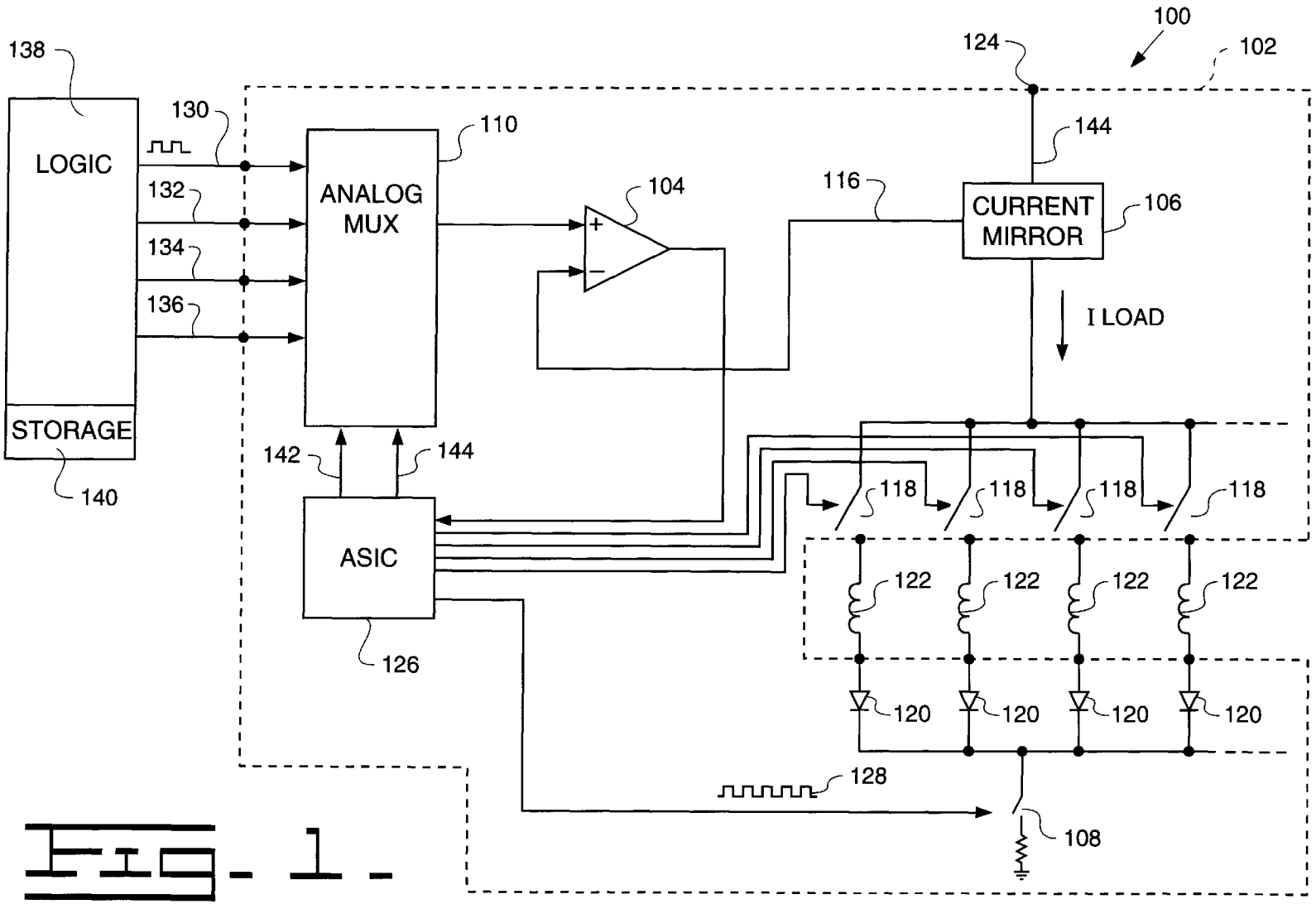
FIG. 1 is a diagrammatic representation of an electronic injector driver system.

Referring now to the drawing, FIG. 1 identifies an injector driver system 100 including an injector driver circuit 102. The injector driver circuit 102 includes a comparator 104, a current mirror 106, a transistor 108 shown generally as a switch, and an analog multiplexer 110. The current mirror 106 includes an input line 114, and a line 116 extends between the current mirror 106 and the comparator 104 providing a voltage to the comparator 104 for comparison with the output voltage from the analog multiplexer 110. A plurality of transistors 118 arranged in parallel connect to the current mirror 106 and a corresponding plurality of diodes 120 arranged in parallel connect to the transistor 108. When the injector driver system is installed in a device, a solenoid load 122 of each injector of the device is connected between one of the transistors 118 and one of the diodes 120, and an electrical energy source 124 of the device is connected to input line 114 of the current mirror 106.

A digital controller 126, which may be an application specific integrated circuit ("ASIC"), is connected to the output of comparator 104, and is also connected to provide a pulse width modulated signal 128 to the transistor 108 to control the on/off switching thereof. Assuming one of the transistors 118 is on, when the transistor 108 is switched on a current is delivered from the electrical energy source 124 through one of the loads 122. In this regard, the driver circuit 102 also includes circuit connections from the ASIC 126 for sequentially switching the transistors 118 on and off.

Input lines 130, 132, 134, and 136 of the injector driver circuit 102 run to the analog multiplexer 110 and are connected to logic means 138 which includes associated information storage means 140. For example, logic means 138 may be a microcontroller and information storage means 140 may be EEPROM of the microcontroller, such EEPROM including a plurality of electronically addressable information storage locations. The ASIC 126 is also connected to logic means 138 via line 142. Logic means 138 is operable to provide a different pwm signal at each of the input lines 130, 132, 134, and 136, which pwm signals are passed through RC filters (not shown) before being applied to the analog multiplexer 110. Accordingly, each pwm signal is essentially converted to an analog voltage level which is applied to the multiplexer 110. Each analog voltage level is proportional to the duty cycle, or pulse width, of its respective pwm signal and the magnitude of the pulse of such signal. As explained below, the current level through a given solenoid load 122 is determined by the magnitude of one of the voltage levels established at the inputs of the multiplexer. Accordingly, logic means 138 normally determines a necessary duty cycle for each pwm signal based upon the desired current level through the load 122.

Typically the magnitudes of the resulting analog voltages established at lines 130 and 132 are relatively high compared to the magnitudes of the resulting analog voltages at lines 134 and 136. These higher level voltages are utilized to set an initial high current level through a solenoid load 122 in order to assure that the solenoid is activated. Once activated, the lower level analog voltages can be utilized to set a lower current level which is sufficient to keep the solenoid 122 activated. In this regard, ASIC 126 determines which analog voltage is provided at the output of the multiplexer 110 to the comparator 104, lines 142 and 144 being provided for such purpose.

For the purposes of the discussion below it is assumed that the analog voltage established at line 130 is greater than the analog voltage established at line 132, and that the analog voltage established at line 134 is greater than the analog voltage established at line 136. In a typical solenoid driving operation, the analog voltage at line 130 is first provided to the comparator 104 and compared with the voltage from current mirror 106, which current mirror voltage is proportional to the current therethrough. The current mirror voltage is initially lower than the multiplexer output voltage, setting a digital level at the output of comparator 104 which is provided to ASIC 126. In response, ASIC 126 sets the signal 128 high in order to increase the average current through the load 122. When the increasing current reaches a certain level, the voltage from the current mirror will exceed the multiplexer output voltage and a change in the level at the output of the comparator 104 will occur. The change in the comparator output level triggers the ASIC 126 to change the signal applied at lines 142 and 144 such that the analog voltage level at line 132 is thereafter provided to the comparator 104. The ASIC 126 then sets signal 128 low in order to decrease the current through the load. The voltage at the current mirror 106 begins to drop until another change in the level of the output of the comparator 104 occurs, triggering the ASIC 126 to cause the multiplexer to again provide the voltage at line 130 to the comparator 104 and sets signal 128 high. Such back and forth operation continues until, after some predetermined time, logic means 138 signals the ASIC to begin alternatingly providing the voltages at lines 134 and 136 through the multiplexer 110 to the comparator 104.

Figure 2:
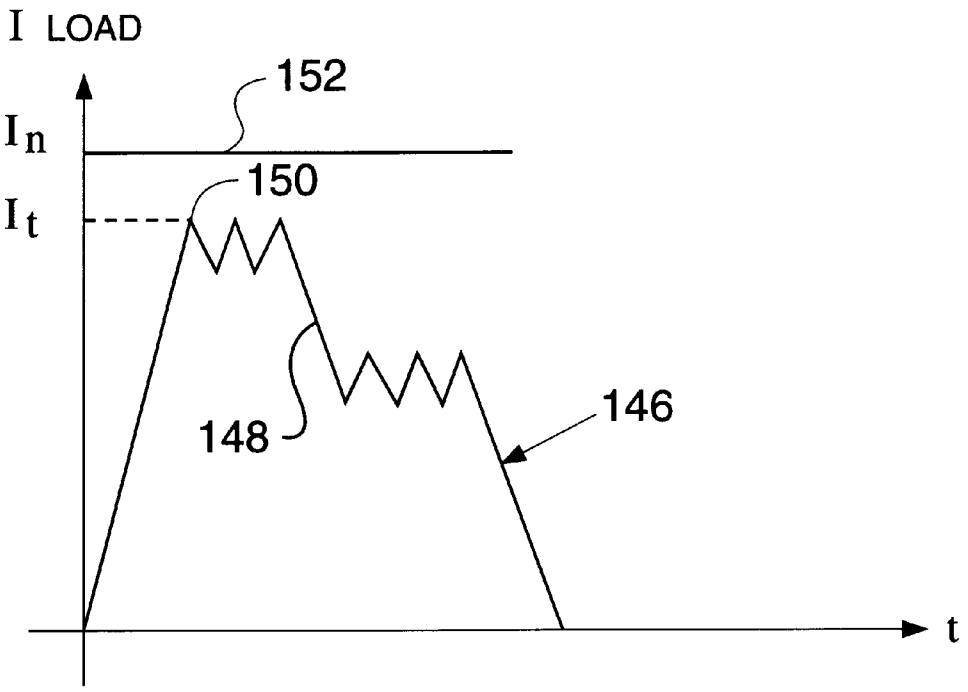
FIG. 2 is a graph depicting a load current waveform for the system of FIG. 1.

Such operation results in an average load current which is depicted by the waveform 146 in FIG. 2. Each peak and valley of the waveform 146 represents a point in time when a change at the comparator output occurs. Further, the downward current level change 148 represents the point in time when logic means 138 signals the ASIC 126 to begin alternatingly providing the voltages at lines 134 and 136 through the multiplexer 110 to the comparator 104. Due to variations in the injector driver circuit components such as the multiplexer 110 and the current mirror 106, and even the magnitude of the pulse signals output by the logic means 138, the actual peak current level at 150 may vary from an expected or nominal peak current level represented by line 152. Similarly, the other peaks and valleys of current waveform 146 may vary from expected values due to such component variations. The calibration method of the present invention is intended to address this variance or error.

The injector driver system 100 is typically assembled on a PC board which is later installed in a device in which the system is utilized. By calibrating the injector driver system 100 after assembly, the accuracy of the injector driver system 100 is improved. Such calibration involves testing the system in order to determine the amount of variance between the actual load current level and the expected load current level. In order to perform such testing, a predetermined test load is connected to the injector driver circuit 102. Preferably, such predetermined test load is closely matched to the load which the injector driver system will be used to drive when installed in a device. The injector driver circuit 102 preferably includes an internal power supply (not shown). Such power supply may also produce a current that is matched roughly to the current that is required by the fuel injector.

A test pwm signal having a predetermined duty cycle (D) is then applied in order to establish an analog voltage level at an input of the multiplexer 110, and the corresponding current level ($I_t$) through the test load is measured. A value indicative of the measured current level ($I_t$) is retrievably stored in the information storage means 140 associated with the logic means 138. With respect to the measurement of the current level ($I_t$), because the current delivered to the test load will actually be a series of current pulses, such current measurement may involve the measurement of an average current through the test load until the peak 150 is reached. Although the measured current level ($I_t$) is depicted as a peak current level in FIG. 2, if a test pwm signal is applied at each input line 130, 132, 134, and 136, the current level measured during calibration could be representative of some other point on the current waveform. Similarly, multiple current level measurements could be taken and then averaged, and compared with an expected, nominal current average.

In operation, the logic means 134 is configured to determine a duty cycle necessary to deliver a desired current ($I_d$) through the load 122, and to utilize the stored value for such purpose. For example, the stored value may be a calibration factor which is the predetermined nominal or expected current ($I_n$) divided by the measured current level ($I_t$), or $(I_n)/(I_t)$.

In an uncalibrated system, logic means 138 would determine a duty cycle (D) based upon the desired current level ($I_d$) only. However, in the calibrated system the logic means 138 determines the duty cycle (D) taking into account the stored calibration factor. For example, the logic means 138 might determine the duty cycle for the desired current level ($I_d$) based upon expected, nominal driver performance, and then multiply the determined duty cycle value by the compensation factor. Alternatively, the desired current level ($I_d$) might first be multiplied by the compensation factor to result in a compensated current level, and then the logic means 138 would determine the necessary duty cycle for the compensated current level based upon expected, nominal driver performance. In either case, the resulting duty cycle will deliver a current which corresponds to the desired current level ($I_d$) because the calibration factor has been taken into account.

The calibration method described above can be achieved utilizing test equipment having the predetermined test load incorporated therein. Such test equipment may further be programmed to determine and store the calibration factor automatically. For example, if the logic means 138 is a microcontroller and the information storage means 140 is EEPROM of the microcontroller, the test equipment will include connections which enable it to electronically store the calibration factor in the EEPROM.

INDUSTRIAL APPLICABILITY

The above-described method results in a calibrated injector driver system which can be utilized to accurately deliver a desired current level ($I_d$) to a load by determining a duty cycle for an input pwm signal necessary to result in the desired current level. Because the injector driver system is calibrated, less precise and accordingly less expensive components may be utilized in constructing the injector driver circuit, reducing the manufacturing cost of the system.

The calibration method may advantageously be utilized in the assembly line setting where a large number of injector driver systems are being assembled, each typically formed on a respective PC board. The logic means 138 of each system can include identical programming which makes reference to the predetermined location where the calibration value is stored. After assembly, each PC board is tested in the aforementioned manner and the determined calibration value is then stored at the predetermined location. Thus, after calibration, each injector driver system includes a stored calibration value which is specific to the driver circuit thereof. The stored calibration value can be used by the logic means 138 when determining the duty cycle for each of the pwm signals applied to lines 130, 132, 134, and 136. The end result is that each injector driver system is calibrated to take into account its own component variations so that, when installed in a device, current levels delivered to an attached load can be more accurately controlled by each respective system.

Although the method provided herein has been described with reference to the illustrated injector driver circuit 102, it is understood that other injector driver circuit variations exist, or could be designed, for which the calibration method of the present invention would be equally applicable and advantageous. The exact configuration of the injector driver circuit utilized will determine the number and nature of the connections required during calibration.

Other aspects, objects and advantages of the present invention can be obtained from a study of the drawings, the disclosure and the appended claims.

We claim:

1. A method of calibrating an injector driver system including logic means operatively connected to an input line of an injector driver circuit, the injector driver circuit configured to deliver a current from an electrical energy source to a load when the electrical energy source and load are connected thereto, the level of the delivered current being proportional to a duty cycle of a pulse width modulated signal applied to the input line by the logic means, the logic means including information storage means associated therewith, the method comprising the steps of:

(a) assembling the injector driver circuit;

(b) connecting a predetermined test load to the injector driver circuit;

(c) applying a first pulse width modulated signal to the input line of the injector driver circuit and measuring a corresponding current level through the test load in response thereto; and (d) storing a value indicative of the measured current level in the information storage means.

2. The method, as set forth in claim 1, wherein the pulse width modulated signal has a predetermined duty cycle.

3. The method, as set forth in claim 1, further comprising the step of determining a calibration value based on the current level measured in step (c) and a predetermined nominal current level, wherein the value stored in step (d) is the calibration value.

4. The method, as set forth in claim 1, wherein the information storage means includes a plurality of electronically addressable information storage locations, wherein in step (d) the value is stored at a predetermined information storage location.

5. The method, as set forth in claim 1, wherein the injector driver circuit is configured to deliver a series of current pulses through the load connected thereto, wherein the current measuring in step (d) involves measuring an average current through the test load.

6. The method, as set forth in claim 1, wherein the logic means is programmable, the method further comprising the step of:

(e) programming the logic means to determine a duty cycle (D), which will result in the delivery of a desired current level ($I_d$) to an attached load, using the value stored in the information storage means in step (d).

7. A method of configuring an injector driver system to enable such system to deliver a desired current level ($I_d$) through a load, the injector driver system including a microcontroller connected to an input line of an injector driver circuit, the microcontroller including associated memory, the method comprising the steps of:

(a) connecting a predetermined test load to the injector driver circuit;

(b) providing a pulse width modulated signal having a predetermined duty cycle to the input line of the injector driver circuit and measuring a corresponding current level ($I_t$) through the test load in response thereto;

(c) storing a value indicative of the measured current level ($I_t$) in the memory associated with the microcontroller; and (d) programming the microcontroller to determine a duty cycle (D) of a pulse width modulated signal, which will result in the delivery of the desired current level ($I_d$) to the load, by using the value stored in the memory in step (d).

8. The method, as set forth in claim 7, wherein the value stored in memory in step (d) is a calibration factor value which is a ratio of a predetermined nominal current level ($I_n$) and the measured current level ($I_t$).

9. The method, as set forth in claim 7, wherein the calibration factor value=$(I_n)/(I_t)$.

10. The method, as set forth in claim 7, wherein in step (d) the value is stored at a predetermined location in the memory.

11. The method, as set forth in claim 10, wherein in step (d) the microcontroller is programmed to refer to the predetermined memory location when determining the duty cycle (D).

12. A calibrated injector driver system, comprising:

an injector driver circuit including an input line;

a load connected to the injector driver circuit;

a microcontroller connected to the input line of the injector driver circuit and having memory associated therewith, the memory including at least one calibration value stored therein, the calibration value being specific to the injector driver circuit, the microcontroller programmed to determine a desired load current ($I_d$) and to determine and effect application of a corresponding necessary pulse width modulated signal having a duty cycle (D) to the injector driver circuit, wherein the duty cycle (D) of the pulse width modulated signal is determined using the stored calibration value.

13. A calibrated injector driver system as set forth in claim 12, wherein the calibration value is a ratio of a predetermined nominal current value and a measured current value.

* * * * *